US006142334A

United States Patent [19]

Kristensson

[11] Patent Number: 6,142,334

[45] Date of Patent: Nov. 7, 2000

[54] OPENING ARRANGEMENT

[75] Inventor: Ingvar Kristensson, Veberöd, Sweden

[73] Assignee: Tetra Laval Holdings & Finance S.A., Pully, Switzerland

[21] Appl. No.: 09/315,994

[22] Filed: May 21, 1999

[30] Foreign Application Priority Data

Jun. 15, 1998 [SE] Sweden ..... 9802117

[51] Int. Cl.[7] ..... B65D 17/34

[52] U.S. Cl. ..... 220/270; 220/258; 220/359.2; 229/123.2

[58] Field of Search ..... 220/258, 270, 220/276, 359.2; 215/232, 254, 349; 229/125.04, 125.05, 125.14, 125.15, 123.2, 160.2

[56] References Cited

U.S. PATENT DOCUMENTS

| | | | |
|---|---|---|---|
| 3,434,620 | 3/1969 | Laurizio . | |
| 3,458,080 | 7/1969 | Laurizio . | |
| 3,532,248 | 10/1970 | Ruekberg . | |
| 3,567,061 | 3/1971 | Song . | |
| 4,149,651 | 4/1979 | Ignell . | |
| 4,568,005 | 2/1986 | Jalovec et al. . | |
| 4,682,702 | 7/1987 | Gach | 215/235 X |
| 4,687,116 | 8/1987 | Dutt et al. . | |
| 4,760,931 | 8/1988 | Gach | 215/235 |
| 4,830,214 | 5/1989 | Curliss et al. | 220/270 |
| 5,301,849 | 4/1994 | Guglielmini et al. . | |
| 5,303,838 | 4/1994 | Luch et al. | 220/276 X |
| 5,772,060 | 6/1998 | Kaneko et al. . | |

FOREIGN PATENT DOCUMENTS

| | | | |
|---|---|---|---|
| 0 337 484 | 10/1989 | European Pat. Off. . | |
| 0 801 007 | 10/1997 | European Pat. Off. . | |
| 5-51034 | 3/1993 | Japan | 229/125.15 |
| 5-77856 | 3/1993 | Japan . | |
| 1589923 | 5/1981 | United Kingdom | 229/123.2 |

*Primary Examiner*—Nathan J. Newhouse
*Attorney, Agent, or Firm*—Burns, Doane, Swecker & Mathis, L.L.P.

[57] ABSTRACT

An opening arrangement including an openable membrane defined by a weakening line. A pulling device is connected to the membrane by a connecting portion made from a flexible material and includes two arms disposed at an angle to one another. Each arm has a center line. A lower arm is connected via a connection to the membrane adjacent the weakening line and at an angle to a plane defined by the weakening line. The center line of each arm defines a plane which extends substantially parallel with a section of the weakening line located adjacent the connection. The opening arrangement ensures that the necessary force for initiating the tearing off of the membrane is minimized without the risk of unintentional leakage increasing. It also provides an opening arrangement in which a relatively small and compact pulling device is used in order to impart extreme tearing forces on the initiation of the tearing off of the membrane.

11 Claims, 2 Drawing Sheets

OPENING ARRANGEMENT

FIELD OF THE INVENTION

The present invention relates to an opening arrangement.

BACKGROUND OF THE INVENTION

Consumer packages for milk, juice and other drinks are available in a multiplicity of different types and sizes, e.g. parallelepipedic packages produced from paper/plastic laminate, blow moulded bottle or beaker-shaped packages of whole plastic material, as well as different types of packaging containers of glass, sheet metal or aluminium. A plurality of these different packaging types include some form of opening arrangement in order to facilitate consumer access to the contents of the package for pouring into drinking vessels or for consumption direct from the packaging container. In packages of bottle type, some form of screw cap is a common solution, while packaging containers of plastic or paper/plastic laminate often include a simple tear indication or a prefabricated pouring aperture which is covered by a tear-off strip, a so-called pull-tab. Separately manufactured opening arrangements of thermoplastic material, for example injection moulded opening arrangements with a pouring spout or a short neck and a snap- or screw cap are also known in the art. Such types of opening arrangements may be injection moulded in situ, i.e. around an opening punched out in the material, so that this is closed and sealed until the consumer opens the opening arrangement. Naturally, injection moulded opening arrangements may also be of different sizes and even cover an entire upper surface panel of a packaging container, in which event they also function as an end wall to the packaging container.

In particular in opening arrangements of the above-mentioned, injection moulded type, it is usual to seal the pouring aperture with some form of tear-off membrane which, on the one hand, ensures that the opening arrangement is completely tight prior to being opened, and, on the other hand, indicates that the package has not previously been opened (tamper-proof). The membrane is often also used in that type of opening arrangement which has a screw or snap-cap for reclosure. In order to make for tearing off of the membrane, this is defined from surrounding parts of the opening arrangement or surrounding parts of the packaging container proper by means of a weakening line which makes it possible to separate the membrane and remove it. In order to facilitate this operation, the membrane is often provided with some form of gripping device or pulling device which makes it possible for the consumer to get a steady grip such that, in particular, the initiation of the tearing operation along the weakening line is facilitated. Initiation of the tearing operation may occasionally cause difficulties (in particular for certain consumers), since the weakening line, despite its obvious, weakening purpose, must not weaken the material to such an extent that rupture and leakage occur. Earlier attempts to obviate the difficulties in the initiation of the tearing off operation have been essentially based on the concept of minimising the necessary force required by ensuring that the weakening line leaves a minimum of residual material thickness, but since tolerances in production are relatively great, a relatively large material thickness must nevertheless be left in order to ensure that leakage does not occur. Other possibilities for facilitating the initiation of the tearing off operation are, naturally, to provide the gripping device with a powerful pull ring or corresponding gripper which makes it possible for the consumer to transmit extreme tractive force to the membrane on the initiation of the tearing operation. This provision is not, however, possible in several types of opening arrangements, for example the type of opening arrangement which includes a short, lidded neck in which the membrane and gripping member are to be accommodated.

There is thus a general need in the art to realise an opening arrangement of the above-outlined type in which the initiation of the tearing off of the membrane is facilitated without any of the above-considered drawbacks occurring.

OBJECTS OF THE INVENTION AND SUMMARY

One object of the present invention is therefore to realise an opening arrangement of the above-mentioned type, the opening arrangement being designed such that the necessary force for initiating the tearing off of the membrane is minimised without the risk of unintentional leakage increasing.

A further object of the present invention is to realise an opening arrangement in which a relatively small and compact pulling device is used in order to impart extreme tearing forces on the initiation of the tearing off of the membrane.

Yet a further object of the present invention is to realise an opening arrangement with a pulling device which ensures that the membrane can be torn off even if the weakening line functions relatively inadequately.

Still a further object of the present invention is to realise an opening arrangement in which the pulling device may be designed to be small and compact so that it is not a hindrance in the forming of the remainder of the opening arrangement.

Yet a further object of the present invention is finally to realise an easily opened opening arrangement which does not suffer from the drawbacks inherent in prior art opening arrangements of corresponding type.

By designing, according to the present invention, the opening arrangement with a pulling device which, through its geometric configuration, ensures that the tractive force on the initiation of the opening phase is directed at an angle to the plane of the weakening line, the force is concentrated to a limited region or point adjacent a section of the weakening line, which ensures that this ruptures already in response to a relatively slight tractive force. The configuration of the pulling device also renders it small and compact and suitable for integration in, for example, opening arrangements which are provided with a neck and sealed with a cap.

BRIEF DESCRIPTION OF THE DRAWINGS

Preferred embodiments of the opening arrangement according to the present invention will now be described in greater detail hereinbelow, with particular reference to the accompanying Drawings which show only those parts and details essential to an understanding of the present invention. In the accompanying Drawings.

Figure 1A:
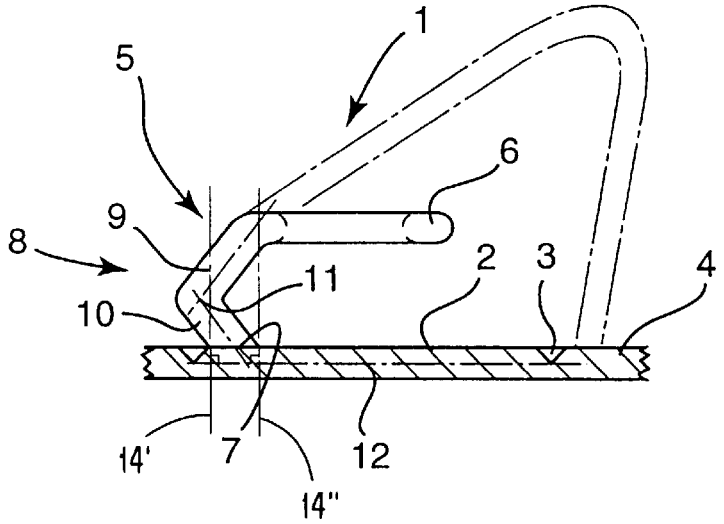
FIG. 1A shows a first embodiment of the opening arrangement according to the present invention seen from the side and partly in section.

The two illustrated, preferred embodiments of the opening arrangement according to the present invention are shown in the Figures in their simplest form, i.e. only those parts and details necessary for an understanding of the present invention have been included. However, it is presupposed that the opening arrangement according to the present invention may be integrated with different types of per se known opening arrangements. Thus, the illustrated embodiments of the opening arrangement according to the present invention may be combined with different types of pouring edges, tubular neck portions, as well as different types of outer caps, for example screw caps or snap caps. The opening arrangement according to the present invention may also be placed on different surfaces in a per se known packaging container or constitute a part of a larger or smaller end wall disposed on an optional packaging container. The placing of the opening arrangement according to the present invention on the packaging container or possible surrounding parts thereof, such as pouring spouts or edges, outer caps or the like does not affect the function of the opening arrangement according to the present invention and will not, therefore, be described in greater detail in this context.

DESCRIPTION OF THE PREFERRED EMBODIMENTS

An opening arrangement 1 according to the present invention includes a membrane 2 which, by means of an endless weakening line 3, is defined from surrounding parts of the opening arrangement 1 or the packaging container 4. A projecting pulling device 5 with a gripping member 6 is connected to the membrane 2 in a connection 7 immediately adjacent a section of the weakening line 3. According to the present invention, the opening arrangement 1 is manufactured from a thermoplastic material which is flexible and elastic and tearable along the weakening line 3. The opening arrangement 1 is preferably of one piece manufacture by injection moulding, either as a separate part or in direct contact with surrounding parts of the packaging container 4, where, for example, the opening arrangement may connect to surrounding parts of a hole made in the packaging container wall, or form a larger part, for example an end wall, of the packaging container proper (not shown). The opening arrangement 1 may also be manufactured as a separate part which, by, for example thermosealing, is sealed in liquid-tight fashion over a prefabricated pouring aperture in the wall of the packaging container. This technique is well known in the art and will not, therefore, be described in greater detail in this context.

As will be apparent from the Drawings, the pulling device 5 also includes, in addition to the already mentioned gripping member 6 (which, for example, may be in the form of a pull ring), a connecting portion 8 which is bent at an angle and includes an upper arm 9 and a lower arm 10 which, via the connection 7, is connected to the membrane 2. Because of the elasticity of the thermoplastic material, the angled connecting portion between the upper arm 9 and the lower arm 10 forms a "pivot point" 11 which does not in itself include any pivot or hinge in the strict sense of the word, but functions in a corresponding manner thanks to the elastic properties of the plastic material. Thus, the designation "pivot point" will be employed in the description and in the appended Claims merely to indicate the connection region of the integrated upper and lower arms 9 and 10, respectively, disposed at an angle to one another, this region functioning as a pivot. In this context, it should also be observed that the pulling device 5, and in particular the connecting portion 8, have the form illustrated in FIGS. 1A, 2A, 3 and 4 in the unloaded state, i.e in the absence of outer forces acting on the connecting portion 8. Those sections of the description and the Claims which refer to the geometric configuration of or relationship between the different parts of the connecting portion thus relate to the connecting portion in its unloaded state unless otherwise is indicated.

Figure 1B:
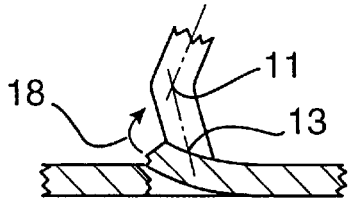
FIG. 1B shows a part of the opening arrangement according to FIG. 1A in connection with the opening phase.

FIGS. 1A and 1B also indicates the centre lines of both arms 9 and 10, as well as how these meet in the pivot point 11. The centre lines of the arms 9 and 10 are located in a common plane (the pivot plane of the pivot point 11), this plane being indicated by reference numeral 16 in FIG. 4. In FIG. 1A, a ghosted line is also used to indicate a plane 12 defined by the weakening line 3 to which plane reference will be made in later sections of this description. It should be observed that the plane 12 is unaffected by any possible configuration deviating from the plane 12 which parts of the membrane 2 may have, for example rigidifying ribs, decorative artwork or other profiling (not shown). It will be apparent from the Figure how the weakening line 3 extends substantially halfway through the material thickness of the opening arrangement, but this may, of course, vary depending upon material type, thickness, desired tear index, etc.

In the first type of opening arrangement according to the present invention which is shown in FIGS. 1A and 1B, the pulling device 5 is located adjacent a section of the weakening line 3, with such orientation that the plane 16 (FIG. 4) formed by the centre lines of the two arms 9 and 10 extends substantially at right angles to the section of the weakening line 3 located adjacent the connecting portion 8.

Figure 2A:
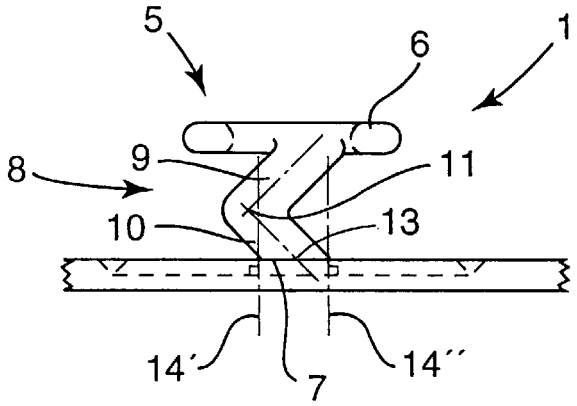
FIG. 2A shows a second embodiment of an opening arrangement according to the present invention seen from the side.
Figure 2B:
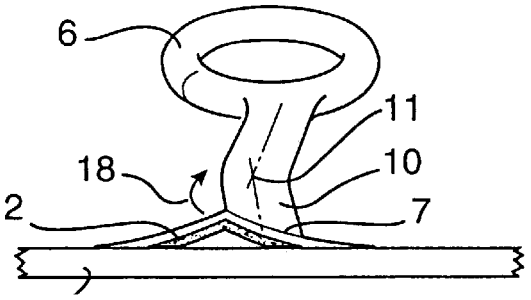
FIG. 2B shows the opening arrangement according to FIG. 2A during the opening phase.

The second embodiment of the opening arrangement according to the present invention illustrated in FIGS. 2A and 2B differs from the firstdiscussed embodiment of the opening arrangement according to the present invention shown in FIGS. 1A and 1B substantially in that the connecting portion 8 has an orientation rotated through 90°, i.e. plane 16 defined by the centre lines of both arms 9, 10 extends, in the second embodiment illustrated in FIGS. 2A and 2B, substantially parallel with a section of the weakening line 3 located adjacent the connecting portion 8. Otherwise, the two embodiments are identical, and corresponding parts and details have therefore been given identical reference numerals in the different illustrated embodiments of the opening arrangement according to the present invention. Thus, it is a common feature shared by both embodiments that the lower arm 10 of the connecting portion 8 connects to the membrane 2 adjacent a section of the weakening line 3 and at an angle to the plane 12 defined by the weakening line 3. The angle deviates from 90° and should probably preferably amount to between 20° and 60°. The angle between both arms of the connecting portion 8 is preferably between 15 and 160°, an angle of substantially 90° having proved to be optimal in the tested embodiments of the opening arrangement according to the present invention. As will be particularly apparent from FIGS. 1A and 2A, the pivot point 11 in which the centre lines of the mutually integrated upper and lower arms 9 and 10 converge is asymmetrically located in relation to the centre of the connection 7 of the lower arm 10 to the membrane 2. For reasons of material savings, the connecting portion 8 preferably has a flattened or oval cross sectional configuration. However, in the common plane 16 of the arms 9 and 10, the connection of the arm 10 to the membrane 2 is of a certain extent, and so the centre line of the lower arm 10 dissects the connection 7 in a centrally located connection centre 13. In such instance, the pivot point 11 proper according to the invention is located outside a region which is defined by two normals 14' and 14" to the plane 12 defined by the weakening line 3, the normals extending through the outer limits of the connection 7 as apparent from FIGS. 1A and 2A.

As will be apparent from FIGS. 1A, 1B, 2A and 2B, the orientation of the connecting portion 8 is such that the connection 7 of the connecting portion 8 to the membrane 2 has its oblong section oriented substantially transversely of an adjacent portion of the weakening line 3 in the first embodiment, and substantially along an adjacent section of the weakening line 3 in the second embodiment. However, as will be described in greater detail below, the function is substantially identical in both embodiments. It should be mentioned in this context that other placings or orientations of the connection 7 are also conceivable, for example at another angle to the weakening line. The essential feature is merely that the break point (i.e. that point in the end of the connection 7 facing towards the weakening line 3 where the tearing-off operation is initiated) is located a short distance (substantially adjacent) the section of the weakening line located most proximal the connecting portion 8.

Figure 3:
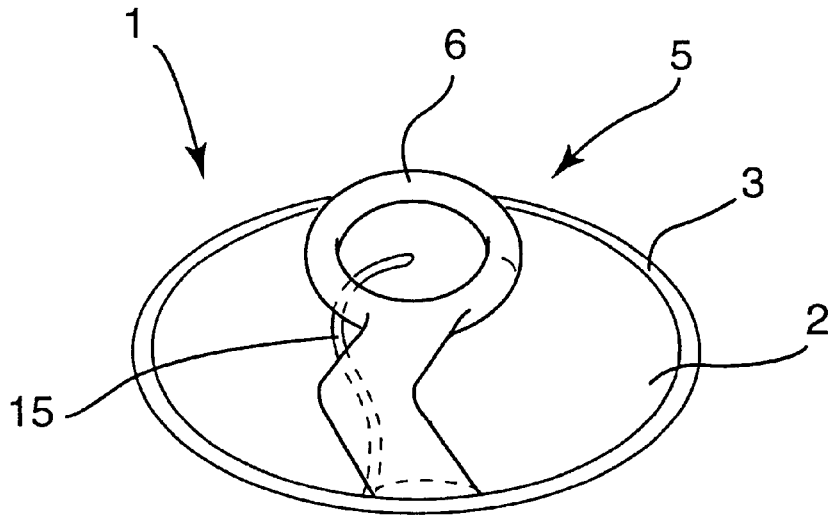
FIG. 3 shows a modified form of the opening arrangement according to FIG. 2A in perspective.
Figure 4:
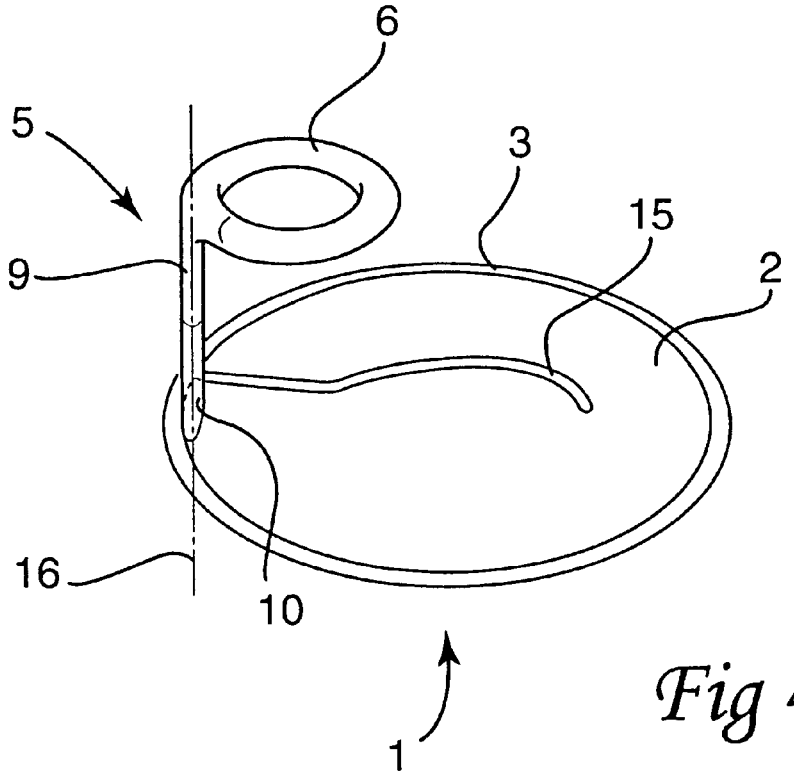
FIG. 4 shows the opening arrangement of FIG. 3 from another perspective.

It will further be apparent from FIGS. 3 and 4 that the membrane 2 is substantially circular, i.e. is defined by a closed or endless weakening line 3. Naturally however, it is possible to impart to the membrane any desired, optional configuration. Nor need the weakening line 3 be endless, but it may, in certain cases, be desirable to design a membrane 2 which, after the opening operation is completed, remains on the packaging container, for which reason the weakening line 3 may have two ends located in spaced apart relationship from one another. This is also a per se known technique which will not be considered in greater detail in this context. In addition to the weakening line 3, which may be designated the main weakening line, the opening arrangement according to the present invention may also be provided with an auxiliary weakening line 15 which extends over the membrane 2 and, at some point, connects to the main weakening line 3. Preferably, the connecting portion 8 of the pulling device 5 is here placed in such a manner that its connection 7 is located immediately adjacent the auxiliary weakening line 15, i.e. close to the point of convergence of the two weakening lines 3 and 15. In this instance, the auxiliary weakening line 15 should preferably connect to the main weakening line 3 more or less at a right angle (radially in relation to the membrane 2), and also extend from the point of convergence towards the centre of the membrane, where it may possibly include a curved section. The auxiliary weakening line 15 may be of the same configuration and depth as the main weakening line 3. The previously discussed arm plane 16 is also illustrated in FIG. 4 by means of a ghosted line, this being the plane in which the centre axes of the upper arm 9 and the lower arm 10 are located.

On utilisation of the opening arrangement according to the present invention, this is presupposed to be placed on a per se optional, known packaging type, for example a parallelepipedic package manufactured from paper/plastic laminate. In this instance, the opening arrangement may constitute a part of the upper wall of the packaging container. When the consumer wishes to open the packaging container, s/he grasps the gripping member 6 of the pulling device 5 projecting out from the surface of the packaging container, then lifts and pulls it upwards, i.e. substantially at right angles to the plane in which the upper surface of the packaging container is located (normally coinciding with the plane 12 defined by the weakening line 3). At this point, as illustrated in FIGS. 1B and 2B, the connecting portion 8 will, because of the flexibility or elasticity of the thermoplastic material, be progressively straightened out, i.e. the angle between the centre axes of the two arms 9 and 10 is reduced in the pivot point 11. At the lower region of the lower arm 10, i.e. its anchorage end or connection 7 to the membrane 2, a twisting moment will, at this point, occur around the connection centre 13 which is indicated by means of the arrow 18 in FIG. 1B. The force generated by the consumer's pulling on the gripping member 6 will hereby be magnified and concentrated at a point adjacent the weakening line 3, which facilitates the initial rupturing of the weakening line. More precisely, the pivoting of the lower arm 10 in a direction towards the normal to the plane defined by the weakening line 3 will generate a twisting moment which is magnified by the different lengths of the two fulcrums. Thus, the length of the centre axis of the lower arm 10 from the pivot point 11 in the connection centre 13 is substantially 2–5 times greater than the length of the fulcrum which is defined by the dimensions of the connection 7 between the connection centre 13 and the end of the connection facing towards the weakening line 3. This gives a powerful increase of the force in the region immediately adjacent the weakening line 3, which considerably facilitates the initiation of the tearing along the weakening line 3. The embodiment of the opening arrangement according to the present invention illustrated in FIGS. 2A and 2B functions in a similar manner, even though the orientation of the connecting portion 8 has been changed through 90° in relation to that section of the weakening line 3 which is located adjacent the connecting portion 8. On pulling in the gripping member 6 substantially upwards in FIG. 2A, the connecting portion 8 will, also in the second embodiment of the opening arrangement according to the present invention, be straightened out, i.e. the angle in the pivot point 11 between the centre line of the upper and lower arms 9, 10, respectively, will increase from the illustrated approx. 90° to approx. 150° or that limit which is determined by the relationships between the thickness of the material in the connecting portion 8 and the flexibility/elasticity of the selected type of plastic material. On straightening of the connecting portion 8, the same magnified twisting moment will occur at the connection 7 as described with reference to FIG. 1, and the rupturing of the adjacent weakening line 3 will, in such instance, be facilitated, which is illustrated in FIG. 2B from which it will be apparent how continued pulling on the gripping member 6 entails that the membrane 2 is torn loose along the weakening line 3.

The provision of the auxiliary weakening line 15 illustrated in FIGS. 3 and 4 further facilitates the rupturing of the opening arrangement according to the present invention, since the initial rupturing will, in such instance, take place in the point of convergence between the main weakening line 3 and the auxiliary weakening line 15. The rupturing thereafter runs along both of the lines until the auxiliary weakening line 15 has been utilised to the full, whereafter the rupturing along the main weakening line continues until the membrane 2 has been wholly released from surrounding parts of the packaging container or the opening arrangement. Naturally, other types of auxiliary lines or other per se known designs and constructions are also possible to combine with one or both of the embodiments of the opening arrangement according to the present invention.

In a slightly modified form of the opening arrangement according to the present invention (illustrated by ghosted lines in FIG. 1A), the pulling device 5 is strip-shaped and connects with its rear end back to the packaging container 4 in the proximity of the rear portion of the membrane 2. In this instance, the strip-shaped pulling device has a front portion which extends at an acute angle in a direction towards the front end of the membrane 2 which is first rupturable, as well as a rear portion located a greater distance from the membrane 2, making space for a finger between the pulling device and the membrane. On opening of the arrangement, the force will here be automatically concentrated to the first rupturable portion of the membrane where the connection of the pulling device is designed in accordance with that previously described, i.e. via a fulcrum which connects adjacent the weakening line.

The opening arrangement according to the present invention offers a compact and simple solution which is not only capable of being well integrated in known types of opening arrangements, but also affords a magnification of the force which considerably facilitates the rupturing of the material in the weakening line and makes this type of opening arrangement suitable also for older and weaker consumers. In opening arrangements of the type where a rupturable membrane is placed in a neck or pouring spout, the opening arrangement according to the present invention makes it possible for the first time to start the rupturing operation with a twisting phase, since a tubular neck in prior art constructions otherwise makes it impossible to apply force in any other manner than substantially at right angles to the plane of the membrane.

The present invention should not be considered as restricted to that described above and shown on the Drawings, many modifications being conceivable without departing from the scope of the appended Claims.

What is claimed is:

1. An opening arrangement comprising: an openable membrane defined by a weakening line, a pulling device connected to the membrane by a connecting portion made from flexible material and including two arms disposed at an angle to one another and each arm having a center line, a lower arm connected via a connection to the membrane adjacent the weakening line and at an angle to a plane defined by the weakening line, the center line of each arm defining a plane extending substantially parallel with a section of the weakening line located adjacent the connection.

2. The opening arrangement as claimed in claim 1, wherein the lower arm connects to the membrane at an angle deviating from 90° to a plane defined by the weakening line.

3. The opening arrangement as claimed in claim 1, wherein the angle between the two arms of the connecting portion is between 15° and 160°.

4. The opening arrangement as claimed in claim 1, wherein the center lines of the two arms are disposed at an angle to one another and converge in a pivot point which is laterally offset with respect to a center of the connection of the lower arm to the membrane.

5. The opening arrangement as claimed in claim 4, wherein the connection of the lower arm to the membrane is located in the plane defined by the center line of each arm, the pivot point being located outside a region which is defined by two normals to the plane defined by the weakening line, said normals extending through outer limits of the connection.

6. The opening arrangement as claimed in claim 1, wherein said membrane is substantially circular.

7. The opening arrangement as claimed in claim 6, including an auxiliary weakening line extending over the membrane and connecting to the weakening line, the connecting portion connecting to the membrane immediately adjacent said auxiliary weakening line.

8. The opening arrangement as claimed in claim 1, wherein the connection of the lower arm to the membrane has an oblong cross sectional configuration, the connection being oriented substantially along the weakening line.

9. The opening arrangement as claimed in claim 8, wherein a length of the lower arm is between two and five times greater than a distance between a center of the connection of the lower arm to the membrane and an end of the connection facing towards the weakening line.

10. An opening arrangement comprising: an openable membrane defined by a weakening line, a pulling device connected to the membrane by a connecting portion made from flexible material and including two arms disposed at an angle to one another and each arm having a center line, a lower arm connected via a connection to the membrane adjacent the weakening line and at an angle to a plane defined by the weakening line, the center line of each arm defining a plane extending substantially perpendicular with a section of the weakening line located adjacent the connection;

wherein the connection of the lower arm to the membrane is located in the plane defined by the center line of each arm, the center lines of the two arms are disposed at an angle to one another and converge in a pivot point, the pivot point being located outside a region which is defined by two normals to the plane defined by the weakening line, said normals extending through outer limits of the connection.

11. The opening arrangement as claimed in claim 10, wherein the connection of the lower arm to the membrane is of oblong cross sectional configuration, the connection being oriented substantially transversely of the weakening line.

* * * * *